United States Patent [19]

Lacaze, Jr.

[11] 4,293,181

[45] Oct. 6, 1981

[54] LOW INSERTION FORCE ELECTRICAL SOCKET CONNECTOR

[75] Inventor: Leonard Lacaze, Jr., San Juan Capistrano, Calif.

[73] Assignee: International Telephone and Telegraph Corporation, New York, N.Y.

[21] Appl. No.: 91,960

[22] Filed: Nov. 7, 1979

Related U.S. Application Data

[63] Continuation of Ser. No. 850,629, Nov. 11, 1977, abandoned.

[51] Int. Cl.[3] ..... H01R 13/11

[52] U.S. Cl. ..... 339/258 R

[58] Field of Search ..... 339/258 R

[56] References Cited

U.S. PATENT DOCUMENTS

| | | | |
|---|---|---|---|
| 2,563,760 | 8/1951 | Uline | 339/258 R |
| 3,170,752 | 2/1965 | Van Horssen | 339/258 R |
| 3,286,222 | 11/1966 | Drinkwater | 339/258 R |

FOREIGN PATENT DOCUMENTS

| | | | |
|---|---|---|---|
| 1237873 | 6/1960 | France | 339/258 R |
| 1463783 | 11/1966 | France | 339/258 R |
| 2318519 | 2/1977 | France | 339/258 R |

*Primary Examiner*—John McQuade

*Attorney, Agent, or Firm*—Thomas L. Peterson

[57] ABSTRACT

An electrical connector socket, particularly for electrical connectors comprising a plurality of pin and socket connections in mating connector assemblies. The conductive socket members, according to the invention, are generally tubular with axial slitting extending from the aperture to form a split-tine arrangement. The converging internal shape of the socket member, according to the invention, is produced by machining, drawing, or other processes not affecting the uniform stress/strain characteristics at the root of the tines. The lateral friction force gripping a pin inserted into the aperture of the socket member is thereby made more predictable and uniform from sample-to-sample, allowing the design of a low-insertion force, multicontact connector.

6 Claims, 10 Drawing Figures

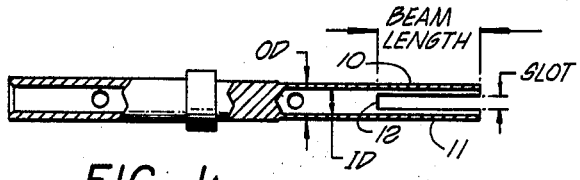
FIG. 1A
FIG. 1B
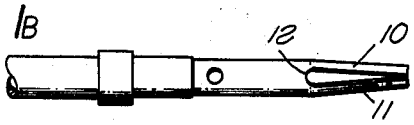
FIG. 1C
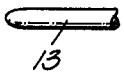
PRIOR ART
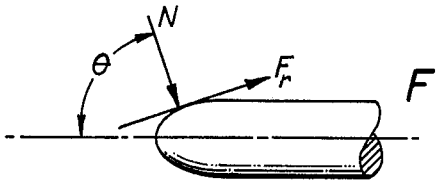
FIG. 2A
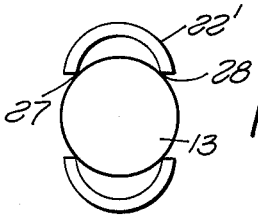
FIG. 3A
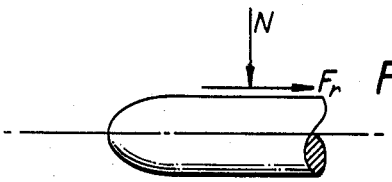
FIG. 2B
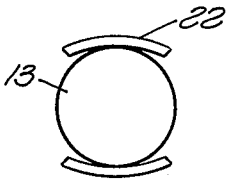
FIG. 3B
FIG. 4A
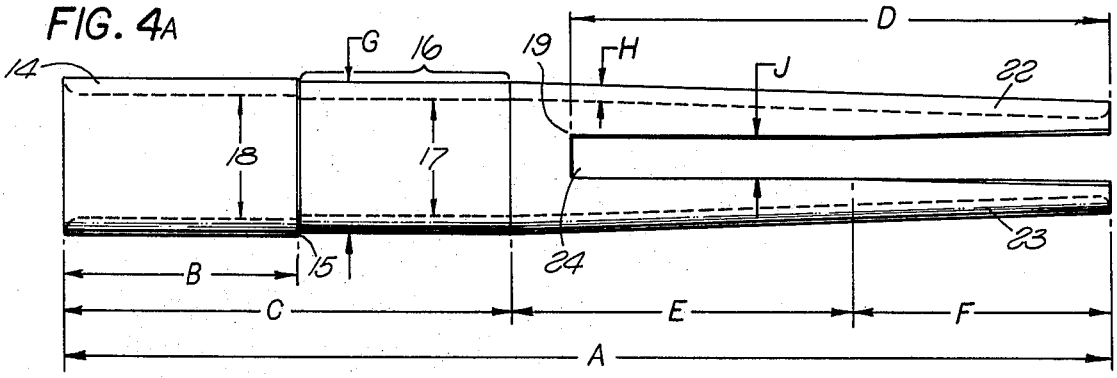
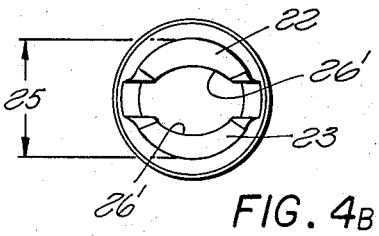
FIG. 4B
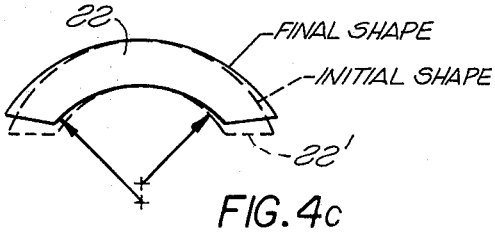
FIG. 4C

LOW INSERTION FORCE ELECTRICAL SOCKET CONNECTOR

CROSS REFERENCE TO RELATED APPLICATION

This application is a continuation of my copending application, Ser. No. 850,629, filed Nov. 11, 1977, now abandoned.

BACKGROUND OF THE INVENTION

1. Field of the Invention

The invention relates generally to socket and pin electrical connectors and, more specifically, to low-insertion force connectors of the type.

2. Description of the Prior Art

In the prior art, the tubular electrical socket contact with split tines is familiar and has been widely employed. Ordinarily, the process of manufacturing the individual socket members, a plurality of which may be included in a multiconnection electrical connector, has been by processes including a step of bending or deforming the tines in a radially inward fashion. This constricts the initial aperture of the socket to an effective diameter less than that of the pin such that when a mating pin is inserted therein, a substantial frictional gripping force is exerted against it. Usually, there is some flaring of the tines outwardly at the aperture or, in other cases, a small amount of countersink is put into the insulating body block holding the socket connector members to provide some guidance, compensating for slight pin misalignments as the connectors are mated.

Typical prior art sockets was extensively described in the technical and patent literature, for example, in U.S. Pat. No. 3,286,222 and in the drawings of U.S. Pat. No. 3,043,925. The socket members in those patents are of the crimped or bent-tine types. Those conventional socket contacts exhibit several sensitive parameters that adversely effect the achievability of repeatable, low insertion force while maintaining satisfactory contact pressure. Those areas of concern are: the modulus of elasticity (or Young's modulus) of the material; length of the beam (considering the tines as cantilevered beams); the moment of inertia of the beam representing the tines (governed by socket outside diameter, inside diameter and slot width); beam deflection called for by the design; and, finally, frictional characteristics of the pins within the sockets.

Forces resisting the mating of the pin and socket are essentially frictional forces arising from the socket tines, producing a normal force; i.e., a frictional force, on the pin. These forces, applied by the socket tines, are more thoroughly analyzed hereinafter. Suffice it to say at this point in the description, that a particular minimum amount of normal force is necessary to assure proper electric conduction. Normal forces in excess of this minimum, however, contribute little to electric conduction but still increase the insertion forces.

In the manufacture of the individual socket members according to prior art methods, the crimping or bending of the tines radially inward produces plastic (inelastic) deformation of the tines at their roots; i.e., adjacent to the inward extremity of the slots which are cut in to produce the tines themselves from the tubular body of the material. Not only does this operation result in work-hardening of the material in the root area, it does so in a relatively unpredictable fashion and nonuniformly with respect to the inside and outside fibers of the tine roots, these being subjected to compressive and tensile deformation, respectively.

The pin-gripping force achievable, according to the aforementioned prior art manufacturing method, is highly variable; therefore, in order to insure the least minimum pin-gripping force for all connections, overdesign in that respect is the usual approach. Thus, particularly in the connector assembly involving the substantial number of socket members, the overall insertion force can be quite large.

The manner in which the invention overcomes the disadvantages of the prior art by providing a unique socket structure, manufactured in accordance with a novel process, will be understood as this description proceeds.

SUMMARY

It may be said to have been the general objective of the invention to produce electrical connector socket members which exhibit highly controllable and repeatable pin-gripping force which may be minimized without the risk of encountering unacceptably low values in one or more socket members where a plurality of these are assembled in a multicontact connector arrangement. The connector assembly may thereby be designed for low insertion force.

The configuration of the socket, according to the invention, beginning on the end opposite the pin aperture end, comprises a first section of essentially tubular (thin-walled, hollow, cylindrical) portion followed by a second section of converging inside and outside diameters (thin-walled conical section) and, finally, into a third or aperture section, modified from the conical convergence to make the cross-section oblate at rest and circular to a larger radius at pin insertion. The reasons for this partial flattening and the method of achieving it will be more thoroughly understood as this description proceeds. The slotting, which forms the tines from the tubular socket walls, comprises two opposite slots bisected by the major diameter of the oblate cross-section formed as aforementioned; in the two-tine preferred embodiment. It may be noted at this point that the partial flattening of each tine is accomplished over an axially length sufficient to accommodate a full insertion of the mating pin; but as a process step, bracing or blocking of the slot outward from the tine roots is provided during the flattening operation to prevent plastic deformation in the vicinity of the tine roots.

The so-called flattening operation produces the oblate shape. It will be realized that the tubing stock from which the part is manufactured, either by machining operations entirely or by a combination of drawing and machining, produces an aperture end of reduced inside and outside diameter as a result of the conical shaping operations hereinabove described. Accordingly, the flattening operation restores the tine aperture end (for a distance accommodating the pin insertion) radius of curvature to that of the pin.

The structure and manufacturing processes of the invention will be more fully understood as this description proceeds. It will be realized that the pin insertion force in a socket member, according to the invention, can be minimized, because the radially outward deflection of the tines produces a resilient gripping force based on more predictable parameters; i.e., more satisfactorily controlled modulus of elasticity and wall thickness of the socket tines at their roots, these being the principal factors governing the frictional pin-gripping force. The tines are tantamount to cantilevered beams of spring-like material, as will be seen from the description hereinafter.

BRIEF DESCRIPTION OF THE DRAWINGS

FIG. 1(*a*) is a cross-sectional view of a typical prior art connector socket member prior to tine crimping or bending.

FIG. 1(*b*) is a pictorial of a socket member such as in FIG. 1(*a*) after the tine bending operation has been accomplished.

FIG. 1(*c*) depicts a typically shaped mating pin insertable in the facing (aperture) end of the socket of FIG. 1(*b*).

FIGS. 2(*a*) and 2(*b*) illustrate insertion force and frictional pin-gripping forces, respectively.

FIGS. 3(*a*) and 3(*b*) illustrate the need for and form of the typical tine partial flattening from the aperture end of the socket according to the invention before flattening and after flattening, respectively.

FIG. 4(*a*) is a side view of a typical socket member according to the invention.

FIG. 4(*b*) is an aperture end view of FIG. 4(*a*).

FIG. 4(*c*) is an enlarged end view of a tine of the socket of FIG. 4(*a*) further illustrating the partial flattening operation which produces the oblate tine cross-section evident from FIG. 4(*b*).

DESCRIPTION OF THE PREFERRED EMBODIMENT

Referring now to FIG. 1, the cross-sectional view is of a typical prior art socket member before the bending of the tines is effected. The generally tubular walls of the socket are axially slotted to a depth 12, producing tines 10 and 11. The OD (outside diameter) of the aperture end is essentially that of the stock, the same applying to the ID (inside diameter). The beam length depicted in FIG. 1(*a*) is of significance throughout the description, this representing the equivalent cantilevered beam represented by each of the tines. The tine root area around 12 is obviously the area of maximum stress as the tines are flexed in operation or when they are inwardly bent as part of the prior art manufacturing process, as illustrated in 1(*b*). Insertion of the pin 13 of FIG. 1(*c*) flexes the tines 10 and 11 in FIG. 1(*b*) radially outward so that they effectively assume a "sprung-out" position gripping the pin 13 along their internal surfaces.

As hereinbefore indicated, a manufacturing step involving the radially inward bending of the tines produces the configuration of 1(*b*) and involves a plastic (inelastic) deformation in the tine root region. This produces work-hardening of the copper base material in the said root region, but not at all uniformly throughout the tine roots. As previously indicated, the inside fibers of each tine are compressed, whereas the outside fibers are deformed plastically as a result of tensile overstressing. By overstressing, it is, of course, meant that the material exceeds its yield point and takes on a "permanent set". As also previously indicated, this prior art manufacturing technique results in large variations in contact and, therefore, also in insertion force, leading to the necessity for acceptance of a high average force in a production lot of such sockets in order to assure that all will have at least the minimum necessary pin-gripping force. The only practical alternate in using the prior art approach is individual inspection and selection of those providing the minimum acceptable, but not an excessive, amount of insertion resistance.

FIGS. 2(*a*) and 2(*b*) are helpful in understanding the geometry of insertion forces and pin-contact friction. Upon pin entry into the socket aperture, the mating force is defined by the relationship depicted in FIG. 2(*a*) and may be expressed as:

$$\text{Mating Force} = R(N \cos\theta + F_r \sin\theta)$$

Once the pin is well within the socket, the mating force may be defined as the product of R and $F_r$. where:

$F_r = \mu N$
R = number of tines
N = normal force
$\mu$ = coefficient of friction Referring now to FIG. 4, a typical socket according to the invention will be described. One practical embodiment according to FIG. 4(*a*) has the following dimensions:

A = 0.353/0.350
B = 0.083/0.080
C = 0.153/0.150
D = 0.182/0.180
E + F ≈ 0.200
G = 0.495/0.0485
H = 0.0060/0.0055
J = 0.014/0.013

The socket member of FIG. 4(*a*) has a sleeve (rear body) portion 14 of axial length B. The inside diameter 18 of this portion 14 may be greater than indicated on a relative visual scale, as might the corresponding outside diameter also be larger than indicated. The purpose of 14 is to provide a wire installing sleeve or, alternatively, a sleeve for receiving an intermediate stub or adaptor which is itself attached to a wire. The purpose, in turn, of providing such an intermediate stub is the avoidance of any crimping of the sleeve 14. The entire socket member according to FIG. 4(*a*) is of a material, preferably a copper alloy having significant spring properties, good machinability, ductility, and conductivity. However, such an alloy may not be ideal for crimping at sleeve 14, hence the intermediate stub alternative, the latter being tightly inserted (press-fit, for example) into the sleeve.

A shoulder which may be chamfered is shown at 15, simply to facilitate mounting against a corresponding internal shoulder in a connector assembly insulating block, a typical expedient in electrical connectors.

A transition or mid-body section 16 having an inside diameter 17 also has an outside dimension G. Its length is equal to C-B and ID 17 is a mating pin clearance dimension, although the pin would not always be inserted to a depth even as great as the full length of dimension D.

So far, the manufacturing process can be one of straight-forward machining operations.

Over the dimensions E and F (forward body section), during manufacture, the stock may be advantageously drawn into a die having the conical shape which begins at the transition from 16 to E and F. A drawing process is particularly advantageous from the point of view that the tine root region around 19 may be formed with closely held material thickness (tubular wall thickness), that being an important factor in controlling the characteristics of the tine considered as a cantilevered beam as aforementioned. Typical dimension H will be seen to call for holding this wall thickness within a 0.0005 range.

Of course, drawing does introduce work hardening, but it is relatively uniform over the material cross-section and is predictable and controllable. Thus, the amount of work hardening introduced by drawing can be predicted and, therefore, factored into the design.

The next step in the process of manufacture would normally be the slotting by cutting, or other known process step, to the depth D and width J. At this step, the slot of sidth J would continue to the aperture of the socket 20. Tines 22 and 23 are thereby formed.

In lieu of drawing, however, full machining operations can be used to complete the process, those machine processes being largely adapted to automatic sequential screw machines.

The process thus far described and the structure which would result would produce the situation depicted in FIG. 3(*a*). The tines which would be generated obviously have the smaller circular cross-section produced by the conical shaping hereinafter described. In FIG. 3(*a*), 22' illustrates this fact, and it will be noted the contact with the pin 13 is limited to two edges 27 and 28. Thus, not only would the spring tines tend to score the pin, but the area of contact between socket end pin is unduly limited thereby. By partially flattening the tines at their aperture ends and for a distance roughly equivalent to the depth of pin insertion into the socket member, the contact area can be shifted more or less to the circumferential inside center surfaces of the tines. The illustrations in FIGS. 3(*a*) and 3(*b*) are obviously exaggerated for emphasis; however, this situation is more realistically portrayed in the partial end view of FIG. 4(*c*). Thus, the tines, 22 for example, in FIG. 4(*a*), have a longer radius, no longer centered on the axial center line of the socket aperture. This is illustrated in FIG. 4(*c*) in that the radius R' of the unflattened tine 22' changes to R for the reshaped tine 22.

FIG. 3(*b*) would indicate that the flattening is such as to produce an effective tine radius greater than the radius of pin 13. This is a possible construction or design choice; however, the radius may be as small as substantially that of the pin 13 itself.

The partial flattening, as it has been called, referring to the process of modifying 22' to the form of 22 for a second predetermined distance inward from the socket aperture, is actually a change of curvature and not actually a flattening in the ordinary sense, but, as such, does represent plastic deformation. In that connection, it is pointed out that bending or flattening action which achieves this change of curvature is accomplished by insertion of a mandrel into the socket aperture or through the socket body from the rear to prevent the application of sufficient bending moment to the tine root region to cause the plastic deformation which is particularly to be avoided.

The plastic deformation thus produced by tine end curvature modification plays no part in the design insofar as insertion and pin frictional forces are concerned, since the new curvature R, once achieved, is a fixed shape.

FIG. 4(*b*) illustrates that the outline of the socket aperture after this so-called flattening operation is an oblate circle; i.e., one in which the dimension 25 is less than the orthogonal dimension of the aperture at the same axial point (same cross-sectional plane). When the pin is inserted into this aperture, the radii of the surfaces of 26 and 26' are at least equal to that of the pin, if not greater.

Various modifications in the axial proportions and dimensions of a socket member according to the invention are obviously possible without department from the structural concepts and manufacturing methods which form the invention. Other dimensional and configuration freedoms will obviously be possible. The socket may obviously be scaled to be consistent with an application.

In view of the possibility for modifications and variations falling within the spirit and scope of the invention, the drawings and this description are to be regarded as typical and illustrative only.

What is claimed is:

1. An electrical connector socket member for receiving a conductive pin of generally circular cross-section inserted longitudinally and extending into said socket member from a forward end thereof;

a rear longitudinal portion of said socket member extending from a rear end of said socket member to an intermediate point thereof;

a forward, hollow longitudinal portion of said socket member having generally conically converging inside and outside diameters and embodying a plurality of integral tines extending from said intermediate point to said forward end, said tines being arranged to elastically deflect radially outwardly when a pin in inserted, for maintaining a radially inward contact pressure against the pin;

said tines having longitudinally extending edges spaced from each other throughout the entire length of said tines, and the distance between said edges over a substantial length of said tines commencing from said intermediate point being substantially constant; and the region about said intermediate point comprising the tine root region, the material of said tine root region having substantially uniform modulus of elasticity throughout.

2. A socket member according to claim 1 in which said tine root region is further defined as being devoid of plastic deformation in the radially inward direction.

3. An electrical connector socket for mating with a conductive pin of substantially uniform circular cross-section to establish an electrical connection comprising:

an elongated metallic socket body having a forward hollow body section terminating in an aperture end for receiving said conductive pin;

said forward body section having generally conically converging inside and outside diameters forming a portion of a right circular cone, said forward body section being axially slotted from said aperture end to form tines;

said tines being partially flattened to increase the radius of curvature of said tines adjacent said aperture end to generally conform to the radius of curvature of said pin;

said slotted forward body section providing a plurality of slots of substantially constant circumferential width behind said partially flattened region; and the material of said socket body being of substantially uniform modulus of elasticity at least over that portion of said forward body section from the inward end of said partially flattened region to the inner ends of said slots, comprising at least a portion of the tine root region.

4. An electrical connector socket for mating with a conductive pin of substantially uniform circular cross-section to establish an electrical connection comprising:

a generally tubular metallic socket body of annular cross-section having a forward aperture end for receiving said conductive pin, said body also having a rear end;

a mid-body section within said socket body comprising a cylindrical shell section;

a rear body section within said socket body between said mid-body section and said rear end comprising a second cylindrical shell of inside and outside diameters at least as large as those of said mid-body section;

a forward body section within said socket body extending between said mid-body section and said aperture end, said forward body section having generally conically converging inside and outside diameters forming a portion of a right circular cone, said forward body section being axially slotted rearwardly from said aperture end to form tines;

the forward portion of said tines being partially flattened to increase the radius of curvature of said tines adjacent said aperture end to generally conform to the radius of curvature of said pin, said slotted forward section providing a plurality of slots of substantially constant circumferential width extending from said partially flattened region toward said mid-body section, the material of said socket body being of substantially uniform modulus of elasticity at least over that portion of said forward body section from the inward end of said partially flattened region to said mid-body section, comprising at least a portion of the tine root region.

5. A socket according to claim 4 in which there are two of said slots spaced circumferentially 180° thereby producing two of said tines.

6. A socket according to claim 4 in which said slots have a length less than said forward body section.

* * * * *